US005872746A

United States Patent [19]

Reiner et al.

[11] Patent Number: 5,872,746

[45] Date of Patent: Feb. 16, 1999

[54] CLOCK TIMER WITH CLOCK FACE TRANSFORMING FROM A FROWNING ORIENTATION TO A SMILING ORIENTATION

[75] Inventors: Norbert L. Reiner; Frank Mercurio, both of Wallingford, Conn.; Sidney Tepper, Millburn, N.J.

[73] Assignee: Sanitoy, Inc., Fitchburg, Mass.

[21] Appl. No.: 656,426

[22] Filed: May 30, 1996

[51] Int. Cl.[6] ..... G04B 19/06

[52] U.S. Cl. ..... 368/223; 368/229; 368/189; 368/97

[58] Field of Search ..... 368/107–109, 368/101–106, 223, 229

[56] References Cited

U.S. PATENT DOCUMENTS

| | | | |
|---|---|---|---|
| 391,271 | 10/1888 | Phelps | 368/229 |
| 3,021,666 | 2/1962 | Stone | 368/229 |
| 3,648,454 | 3/1972 | Morrison | 368/2 |
| 3,796,043 | 3/1974 | Ebdon | 368/229 |
| 5,044,961 | 9/1991 | Bruskewitz | 368/45 |

FOREIGN PATENT DOCUMENTS 10234 12/1991 European Pat. Off. .

*Primary Examiner*—Bernard Roskoski
*Attorney, Agent, or Firm*—Davis and Bujold

[57] ABSTRACT

A clock timer having a face comprising a mouth, eyes, a nose, and an arm secured to the nose. Rotation of the nose turns a shaft which, via a camming mechanism, forces a plate housed within the clock upward. As the plate moves upward, a rack formed in the plate drives a gear mechanism which rotates the mouth and eyes from a smiling orientation to a frowning orientation. Rotation of the shaft also rotates a timer housed within the clock. Upon expiration of the timer the shaft is rotated in the opposite direction, thereby lowering the plate, driving the gear mechanism, and rotating the mouth and eyes from their frowning orientation to their smiling orientation, and activating a bell housed in the timer.

13 Claims, 2 Drawing Sheets

CLOCK TIMER WITH CLOCK FACE TRANSFORMING FROM A FROWNING ORIENTATION TO A SMILING ORIENTATION

FIELD OF THE INVENTION

This invention relates to a clock timer and more particularly to a clock timer having a clock face which when actuated transforms from a frowning orientation to a smiling orientation upon expiration of a desired period of time.

BACKGROUND OF THE INVENTION

It is very common today, when disciplining children, to use what is known as a "time out" when the child has misbehaved. The time out is a period of time where the child is removed from a situation and required to sit quietly. Timing mechanisms, or clock timers, can be used to measure the length of the time out period.

Timers are well known in the art. Such timers, upon expiration of a desired length of time, typically actuate a bell, buzzer or other audible signal in order to communicate to an individual the expiration of the time period.

These timers are not visually oriented and are not designed with children in mind.

SUMMARY OF THE INVENTION

Wherefore, it is an object of the present invention to provide a timing device which provides a visual indication for an individual upon expiration of a desired time period.

Another object of the present invention is to provide a timing device which, when actuated, transforms a display from a frowning orientation to a smiling orientation upon expiration of a desired time period.

The present invention relates to a timer driven display having movable display indicia responsive to the timer comprising a display face having at least one changeable display indicia; a timer providing an output movement to an output shaft when the timer is active; an actuator mechanism connected to the output shaft to adopt a first operable state during the output movement of the timer and a second operable state when the timer is inactive; and the at least one changeable display indicia being operably connected to the actuator mechanism to produce desired movement of the display indicia upon changes in the operable states of the actuator.

The present invention also relates to a timer driven display having movable display indicia responsive to the timer comprising a display face having at least one changeable display indicia; a timer providing an output movement to an output shaft when the timer is active; an actuator mechanism connected to the output shaft to adopt a first operable state during the output movement of the timer and a second operable state when the timer is inactive, the actuator mechanism comprising a slotted member having an aperture located centrally therein, freely rotating about the output shaft, and a radial slot adjacent the aperture extending to an outer edge of the slotted member, a camming member secured to the output shaft adjacent the slotted member, having a slot adjacent the output shaft extending to an outer edge of the camming member, the slot having a radial edge and a camming edge sloping away from the radial edge, and a plate adjacent the camming member having a keyhole shaped aperture centrally located therein and a pin secured to the plate adjacent the aperture and projecting toward the camming member, the pin, when the timer is inactive, being positioned within the camming slot and the slot, the keyhole shaped aperture having a rack formed in a rectangular portion therein; and the at least one changeable display indicia being operably connected to the actuator mechanism to produce desired movement of the display indicia upon changes in the operable states of the actuator.

The present invention additionally relates to a timing mechanism for actuating a display on a clock face comprising a timer having an active state and an inactive state; a drive member connected to the timer; a shaft secured to the drive member; a slotted member having an aperture located centrally therein, freely rotating about the shaft adjacent the drive member, and a radial slot adjacent the aperture extending to an outer edge of the slotted member; a camming member secured to the shaft adjacent the slotted member, having a slot adjacent the shaft extending to an outer edge of the camming member, the slot having a radial edge and a camming edge sloping away from the radial edge; a plate adjacent the camming member having a keyhole shaped aperture centrally located therein, the aperture having a rack formed in a rectangular portion therein; a pin secured to the plate adjacent the aperture and projecting toward the camming member, the pin, when the timer is in the inactive state, being positioned within the camming slot and the slot; a driving gear secured to a driving rod, the driving gear meshing with the rack; a transition gear meshing with the driving gear; at least one driven gear secured to at least one rod, meshing with the transitional gear; a housing having a recess located in a rear portion therein; a clock face on a front surface of the housing; an actuator on the clock face secured to the shaft for setting a duration of the active state of the timer; and at least one display element on the clock face, each of the at least one display elements being secured to one of the driving rod and the at least one rod.

BREIF DESCRIPTION OF THE DRAWINGS

The invention will now be described, by way of example, with reference to the accompanying drawings in which.

DESCRIPTION OF THE PREFERRED EMBODIMENTS

Figure 1:
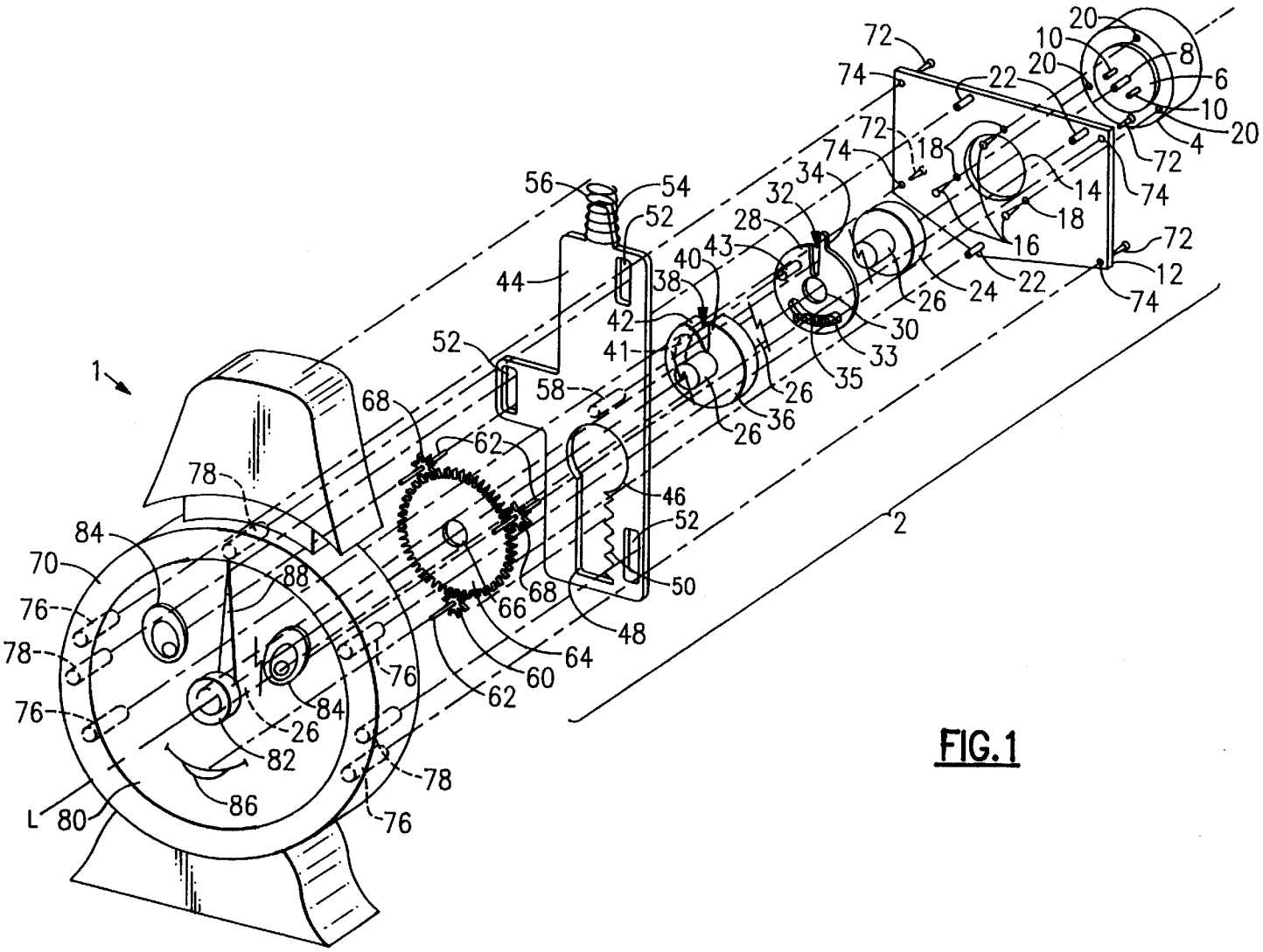
FIG. 1 is a diagrammatic exploded perspective view of the clock timer of the present invention.

Turning now to FIG. 1, a detailed description concerning the present invention will now be provided.

A clock timer embodying the invention is generally designated as 1 and defines central axis L. Timing device 2 comprises a timer 4, having gear 6 centrally located therein, having an axis of rotation coincident with central axis L. Rod 8 projects axially along central axis L from the center of gear 6. Pins 10 also project axially from gear 6, adjacent rod 8 and offset from central axis L. Timer 4 is a readily available conventional manual timer having an internal bell or buzzer (not shown) which is activated by rotating gear 6 about rod 8, and a further detailed description of timer 4 will therefore not be provided.

Mounting plate 12 has aperture 14 located centrally therein, through which rod 8 and pins 10 of timer 4 project when mounting plate 12 is secured to timer 4. Threaded fasteners 16 are inserted through holes 18 in mounting plate 12 into threaded holes 20 in timer 4, thereby securing mounting plate 12 to timer 4. Hollow cylindrical supports 22 project axially away from mounting plate 12 on a side of mounting plate 12 opposite timer 4.

Drive member 24 is a generally cylindrical member located adjacent mounting plate 12, having an axis of rotation and a central recess (not shown) coincident with central axis L. The central recess, sized to accommodate rod 8, and outer recesses (not shown), offset from central axis L and sized to accommodate pins 10, are located on a side of drive member 24 facing mounting plate 12. Shaft 26, shown in broken section, projects axially from the opposite side of drive member 24.

Disc 28 is a generally circular member located adjacent drive member 24 having an axis of rotation coincident with central axis L and aperture 30, centrally located therein and coincident with central axis L, which is sized to allow disc 28 to rotate freely about shaft 26. Slot 32 projects radially from a point adjacent aperture 30 to the outer edge of disc 28. Tab 34 projects from the periphery of disc 28 adjacent and along one side of slot 32. Arcuate slot 33 is located opposite slot 32, intermediate aperture 30 and an outer edge of disc 28. Spring 35 is secured at a first end thereof to a projection (not shown) on one end of arcuate slot 33 and at its second end to cam 36, located adjacent disc 28.

Cam 36 is a generally circular member of the same diameter as disc 28, secured to shaft 26, thereby rotating with shaft 26 about its axis of rotation, which is coincident with central axis L. Camming slot 38 projects generally radially along cam 36 from a point adjacent shaft 26 to an outer edge of cam 36. Camming slot 38 has a first surface 40 which projects radially and aligns with the edge of slot 32 of disc 28 which is adjacent tab 34 when timing device 2 is in an inactive state. Camming slot 38 has a camming surface 42, opposed to and sloping away from first surface 40. Arcuate groove 41 (shown in dashed lines) is located on a side of cam 36 facing disc 28, adjacent camming surface 42. Spring 35 is secured to a projection (not shown) on an end of arcuate groove 41. Stem 43 is located on disc 28 and aligns and slidingly mates with groove 41. As cam 36 rotates in either direction, disc 28 rotates freely until stem 43 engages a corresponding end of groove 41 and thereafter disc 28 rotates with cam 36.

Plate 44 is located adjacent cam 36 and has keyhole shaped aperture 46 located about central axis L. A rectangular portion 48 of keyhole shaped aperture 46 projects toward a lower portion of plate 44 and has rack 50 along one edge thereof. Vertically oriented guide slots 52 are located along outer edges of plate 44. Projection 54, located along a top edge of plate 44, supports compression spring 56 which projects along the plane of plate 44 perpendicular to central axis L. Guide pin 58 (shown in dashed lines), projecting toward cam 36, is located proximate aperture 46 and is positioned in the bottoms of camming slot 38 and slot 32 when timing device 2 is in an inactive state.

Driving gear 60, located adjacent plate 44, is secured to post 62, which projects axially from both sides of driving gear 60 parallel to central axis L, and meshes with rack 50. Transition gear 64, having central aperture 66 coincident with central axis L which allows transition gear 64 to rotate freely about shaft 26, meshes with driving gear 60. Transition gear 64 in turn meshes with driven gears 68 which are secured to posts 62, which project axially from both sides of driven gears 68 parallel to central axis L. The portions of posts 62 projecting towards plate 44 are inserted into cylindrical supports 22 on mounting plate 12.

Clock housing 70 contains timing device 2 within a recess (not shown) located in a rear portion therein. Timing device 2 is secured within clock housing 70 via threaded fasteners 72 which are inserted through holes 74 in mounting plate 12 and secured to threaded holes 76 (shown in dashed lines) in a rear of clock housing 70. Guide posts 78 (shown in dashed lines) project from the rear of clock housing 70 through guide slots 52 in plate 44. Compression spring 56 is contained within a top portion of the recess (not shown) in the rear of clock housing 70.

Clock face 80, located on a front surface of clock housing 70, comprises nose 82, eyes 84, mouth 86, and arm 88 which projects radially from nose 82. Eyes 84 are secured to posts 62 of driven gears 68, mouth 86 is secured to post 62 of driving gear 60, and nose 82 is secured to shaft 26.

A description of the operation of clock timer 1 will now follow. Clock timer 1 is shown in an inactive, or smiling, orientation in FIG. 2 and in its activated, or frowning orientation, in FIG. 3. Clock timer 1 is activated by rotating nose 82 in a clockwise direction relative to clock face 80, which in turn rotates arm 88 a desired distance around clock face 80, thereby setting a desired time period for the clock timer to run, and shaft 26, upon which nose 82 is secured. Cam 36, being secured to shaft 26, is also turned in a clockwise direction. As cam 36 turns, guide pin 58, which is secured to plate 44 and located in the bottoms of camming slot 38 and slot 32, slides upward along camming surface 42, forcing plate 44 to move upward as well. As plate 44 moves upward, guide pin 58 also slides upward through slot 32 in disc 28. Disc 28 does not rotate since guide pin 58 is moving upwardly through slot 32 and stem 43 is sliding along groove 41. Plate 44 is prevented from rotating by guide slots 52 which slide vertically about guide posts 78, thereby causing plate 44 to move exclusively in a vertical direction.

As cam 36 rotates, spring 34, which connects cam 36 to disc 28, is stretched in tension. When guide pin 58 reaches the outer edge of slot 38 in cam 36 it also reaches the outer edge of slot 32, thereby freeing disc 28 to rotate about shaft 26. The tension in spring 34 then causes disc 28 to rotate in a clockwise direction until stem 43 engages an end of groove 41 and once again align slot 32 of disc 28 with camming slot 38 of cam 36. As nose 82 is rotated further, guide pin 58 rides along the outer edge of cam 36 and disc 28, thereby maintaining plate 44 at a constant height. At this point plate 44 is at its uppermost position, compressing compression spring 56 within the recess (not shown) in the rear of clock housing 70. As nose 82 is rotated further yet, completing one full revolution, guide pin 58 engages tab 34 thereby preventing further rotation of nose 82 and shaft 26.

As plate 44 moves upwardly during rotation of nose 82, rack 50 turns driving gear 60, which is secured to mouth 86 via post 62, in a counter clockwise direction. Mouth 86 is therefore rotated about post 62 from its smiling orientation shown in FIG. 2 to its frowning orientation shown in FIG. 3. Simultaneously, driving gear 60 meshes with transition gear 64 turning it in a clockwise direction, and transition gear 64 meshes with driven gears 68 rotating them in a counter clockwise direction. Eyes 84, which are secured to posts 62 and rotate with driven gears 68, therefore transform as well from their smiling orientation shown in FIG. 2 to their frowning orientation shown in FIG. 3.

The rotation of nose 82 and shaft 26 rotates drive member 24 as well. Gear 6 and rod 8 of timer 4, which is connected to drive member 24 by pins 10, are rotated about central axis L in a clockwise manner, thereby engaging the internal timing mechanism of timer 4. As timer 4 operates it rotates in a counter clockwise direction thereby rotating shaft 26, cam 36, disc 28, nose 82 and arm 88 in a counter clockwise direction as well. When disc 28 and cam 36 are rotated such that guide pin is aligned above slots 32 and 38 at the expiration of the time set in timer 4, the compressive force of compression spring 56 forces plate 44 downward to its original lowermost position. As plate 44 moves downward, rack 50 forces driving gear 60 to rotate in a clockwise direction, thereby transforming mouth 86 from its frowning orientation shown in FIG. 3 back to its smiling orientation shown in FIG. 2.

Figure 3:
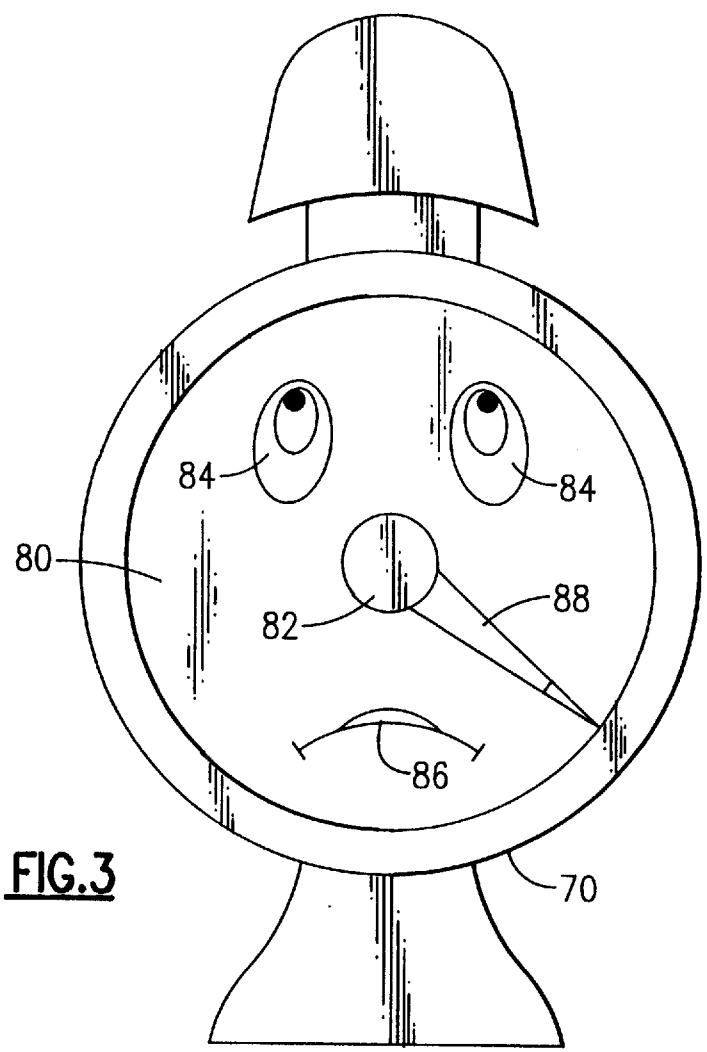
FIG. 3 is a diagrammatic elevation of the clock face, shown in a frowning orientation, of the clock timer of FIG. 1.
Figure 2:
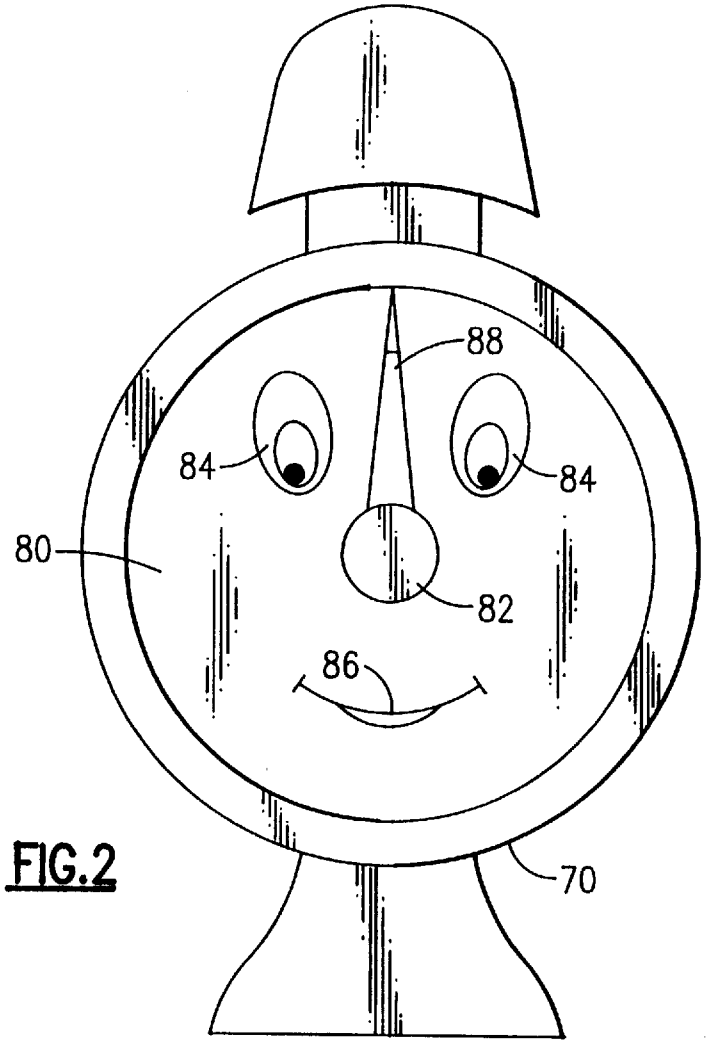
FIG. 2 is a diagrammatic elevation of the clock face, shown in a smiling orientation, of the clock timer of FIG. 1.

The downward movement of plate 44 also causes a clockwise rotation of eyes 84, via transition gear 64 and driven gears 68, thereby transforming eyes 84 from their frowning orientation shown in FIG. 3 back to their smiling orientation shown in FIG. 2.

At the expiration of the time set in timer 4, simultaneously with the transformation of eyes 84 and mouth 86 from their frowning orientations to their smiling orientations, the bell or buzzer (not shown) in timer 4 is activated. The bell may be supplemented or replaced by a voice recording which is pre recorded or operator recorded.

The clock timer 1 has been described in terms of a transformation from a frowning orientation to a smiling orientation upon expiration of the time set in timer 4. Other embodiments are possible including ones where the clock timer 1 transforms from an orientation where teeth in the mouth 86 (not shown) are hidden to an orientation where the teeth are exposed upon expiration of the time set in timer 4.

Wherefore, I/we claim:

1. A timer driven display having movable display indicia responsive to the timer comprising:

a) a display face having at least one changeable display indicia;

b) a timer providing an output movement to an output shaft when the timer is active;

c) an actuator mechanism connected to the output shaft to adopt a first operable state during the output movement of the timer and a second operable state when the timer is inactive, said actuator mechanism comprising:

a slotted member having an aperture located centrally therein, freely rotating about said output shaft, and a radial slot adjacent said aperture extending to an outer edge of said slotted member, a camming member secured to said output shaft adjacent said slotted member, having a slot adjacent said output shaft extending to an outer edge of said camming member, said slot having a radial edge and a camming edge sloping away from said radial edge, and a plate adjacent said camming member having a keyhole shaped aperture centrally located therein and a pin secured to said plate adjacent said aperture and projecting toward said camming member, said pin, when said timer is inactive, being positioned within said camming slot and said slot, said keyhole shaped aperture having a rack formed in a rectangular portion therein; and d) the at least one changeable display indicia being operably connected to the actuator mechanism to produce desired movement of the display indicia upon changes in said operable states of the actuator.

2. A timing mechanism for actuating a display on a clock face comprising:

a) a timer having an active state and an inactive state;

b) a drive member connected to said timer;

c) a shaft secured to said drive member;

d) a slotted member having an aperture located centrally therein, freely rotating about said shaft adjacent said drive member, and a radial slot adjacent said aperture extending to an outer edge of said slotted member;

e) a camming member secured to said shaft adjacent said slotted member, having a slot adjacent said shaft extending to an outer edge of said camming member, said slot having a radial edge and a camming edge sloping away from said radial edge;

f) a plate adjacent said camming member having a keyhole shaped aperture centrally located therein, said keyhole shaped aperture having a rack formed in a rectangular portion therein;

g) a pin secured to said plate adjacent said keyhole shaped aperture and projecting toward said camming member, said pin, when said timer is in said inactive state, being positioned within said camming slot and said slot;

h) a driving gear secured to a driving rod, said driving gear meshing with said rack;

i) a transition gear meshing with said driving gear;

j) at least one driven gear secured to at least one rod, meshing with said transitional gear;

k) a housing having a recess located in a rear portion therein;

l) a clock face on a front surface of said housing;

m) an actuator on said clock face secured to said shaft for setting a duration of said active state of said timer; and n) at least one display element on said clock face, each of said at least one display elements being secured to one of said driving rod and said at least one rod.

3. A timing mechanism according to claim 2, wherein said at least one display element defines eyes and a mouth on said clock face.

4. A timing mechanism according to claim 2, wherein said actuator defines a nose on said clock face.

5. A timing mechanism according to claim 2, comprising at least one guide slot formed in said plate; and at least one guide post projecting from a rear portion of said housing to mate with said at least one guide slot.

6. A timing mechanism according to claim 2, comprising a tension member secured at a first end thereof to a surface of said slotted member facing said camming member and at a second end thereof to a surface of said camming member facing said slotted member.

7. A timing mechanism according to claim 2, comprising a compressive member connected to a top surface of said plate.

8. A timing mechanism according to claim 7, wherein said compressive member, when compressed, is housed within said recess in said housing.

9. A timing mechanism according to claim 2, comprising a tab on an outer edge of said slotted member adjacent said slot.

10. A timing mechanism according to claim 2, wherein the at least one display element is in a first operable state when said timer is in said active state and in a second operable state when said timer is in said inactive state.

11. A timing mechanism according to claim 2, wherein said at least one display element defines a frown on said clock face when said timer is in said active state and a smile on said clock face when said timer is in said inactive state.

12. A timing mechanism according to claim 2, comprising an indicator arm secured to said actuator for indicating a length of said active state.

13. A timing mechanism according to claim 2, comprising at least one of a buzzer, a bell, a pre recorded voice recording, and an operator recorded voice recording which is activated upon an expiration of said active state.

* * * * *